US006349577B1

(12) United States Patent
Hansen et al.

(10) Patent No.: US 6,349,577 B1
(45) Date of Patent: Feb. 26, 2002

(54) TRUCK BOX PADDLE HANDLE ASSEMBLY WITH ROTATABLE RELEASE MECHANISM

(75) Inventors: Randall C. Hansen, 6 Old Mill Ct., Columbia, SC (US) 29606; Dennis J. Sadler, Irmo, SC (US); Michael V. Akright, Columbia, SC (US); William H. Poteat, Lugoff, SC (US)

(73) Assignee: Randall C. Hansen, Columbia, SC (US)

( * ) Notice: Subject to any disclaimer, the term of this patent is extended or adjusted under 35 U.S.C. 154(b) by 0 days.

(21) Appl. No.: 09/426,626

(22) Filed: Oct. 26, 1999

(51) Int. Cl.[7] ..... B65D 55/14
(52) U.S. Cl. ..... 70/159; 292/DIG. 31
(58) Field of Search ..... 292/59, 213, DIG. 31; 70/159, 162, 169, 173, 208

(56) References Cited

U.S. PATENT DOCUMENTS 3,302,434 A * 2/1967 Dauenbaugh et al. ..... 70/208
4,597,599 A 7/1986 Bisbing
4,835,997 A 6/1989 Akright
5,467,619 A * 11/1995 Stillwagon et al. ..... 70/34
5,875,948 A 3/1999 Sadler
5,941,104 A 8/1999 Sadler
5,983,682 A * 11/1999 Parikh ..... 70/208
5,984,383 A * 11/1999 Parikh et al. ..... 292/121
6,048,006 A * 4/2000 Antonucci et al. ..... 292/336.3
6,149,213 A 11/2000 Sokurenko et al.
6,240,752 B1 * 6/2001 Larsen et al. ..... 70/208

OTHER PUBLICATIONS

Drawing dated Aug. 25, 1998, of New Holland rotatable head latch.

* cited by examiner

*Primary Examiner*—Lynne H. Browne
*Assistant Examiner*—John B. Walsh
(74) *Attorney, Agent, or Firm*—Dority & Manning, P.A.

(57) ABSTRACT

This invention provides a latch assembly in which the operation of a paddle-type recessed handle pivots an actuating member carried on a rear side of the latch assembly. As the latch assembly pivots, a contact member of the latch assembly engages and moves an operating member. As the operating member moves, a cylindrical keeper stud is rotated. One end of the keeper stud is adapted for engagement within a receiver mechanism and in a first locked position. Upon rotation of the keeper stud, the receiver and keeper are placed in a unlocked orientation whereby the receiving element may be disengaged from the keeper stud.

42 Claims, 9 Drawing Sheets

TRUCK BOX PADDLE HANDLE ASSEMBLY WITH ROTATABLE RELEASE MECHANISM

BACKGROUND OF THE INVENTION

The present invention relates to a truck box with a paddle handle actuated latching mechanism having a rotatable release mechanism.

Boxes and containers designed to fit securely within the bed of a pick-up truck have become increasingly popular. Such boxes are extensively used by tradesmen and contractors who require a secure storage compartment for holding tools and equipment and require a secure lockable container for their equipment.

Different lid arrangements are known in the art including wing-style lids which open along each side of the box as well as a single hinged lid which opens along a length of the box.

One such locking lid arrangement can be found in U.S. Pat. No. 5,226,302 to Anderson assigned to Loctec Corporation which is incorporated herein by reference. This reference provides a latch mechanism in which a notched plunger is mounted from an overhead lid of the truck box. As the plunger is inserted into an opening of the latch assembly, the plunger self-adjusts for proper alignment and results in a lock self-adjustable in six directions.

U.S. Pat. No. 5,941,104 to Sadler, which is incorporated herein by reference, is directed toward a paddle lock which provides a latching mechanism which latches and unlatches upon a striker element and is actuated by movement of the handle member.

While the examples discussed above provide useful latching mechanisms, there remains room for variation and improvement within the art.

SUMMARY OF THE INVENTION

It is therefore a principal object of the present invention to provide a paddle latch assembly which offers an improvement and useful variation in the operation of a latch assembly.

It is a further object of the present invention to provide a latch assembly having a rotatable keeper stud in operative engagement with the handle, the keeper stud having a first secured position within a receiving mechanism which, upon engagement of the paddle handle, the keeper stud rotates to a second releasable position within the receiving mechanism.

It is still a further object of the present invention to provide a receiving mechanism for a rotatable keeper stud, the receiving mechanism providing a self-adjusting feature to facilitate the alignment and engagement of the keeper stud within the receiving mechanism.

It is still a further and more particular object of the present invention to provide a latch assembly having an actuating member pivotally connected to a handle, the actuating member having an improved engagement profile for facilitating the deployment of an operating member upon movement of the handle member.

In accordance with the objects of the invention, the present latch assembly is for use with a receiving mechanism defining a receptacle, the latch assembly including a tray having a front side and a back side; a handle member pivotally mounted to the tray; an actuating member mounted to the handle member to pivot therewith relative to the tray; an operating member rotatably mounted onto a mounting element extending from the back side of the tray, the operating member further defining a pin contacted by the actuating member upon movement of the handle member; a keeper stud having a first terminus defining a plurality of notches and a second terminus defining a base, the base rotatably mounted onto the mounting element extending from the back side of the tray and the operating member non-rotatably mounted to the keeper stud base; a receiving mechanism defining a receptacle reversibly contacted by the keeper stud, wherein when the actuating member rotates the cam surface of the operating member to an unlocked position, the surrounding keeper stud rotates from the locked orientation to the unlocked orientation.

Additional features and advantages of the present invention are provided by a latch assembly comprising a receiving mechanism adapted for attachment to a lower surface of a lid of a receptacle; a handle member pivotally mounted to a housing, the housing secured to a wall of the receptacle, the handle being accessible from an exterior of the receptacle; a keeper stud operatively engaged by the handle and defining a first end having at least one notched edge which engages an edge member within the receiving mechanism when the keeper stud is in a first locked orientation, the keeper stud rotating into a unlocked position upon engagement of the handle member, the unlocked position disengaging the at least one notched edge from the edge member of the receiving mechanism and thereby permitting removal of the lid and receiving mechanism from the keeper stud.

Further aspects of the present invention are provided by a latch assembly comprising a tray having a front side and a back side; a handle member pivotally mounted to the tray via an axle; an actuating member mounted to the axle and responsive to the handle member to pivot therewith relative to the tray, the actuating member defining an engaging surface disposed between a base end of the actuating member adjacent the axle and a distal end of the actuating member, the engaging surface being curved and configured so that the engaging surface extends more radially relative to the axle nearer the base end and less radially relative to the axle nearer the distal end; and an operating member mounted to the tray so as to be movable relative thereto and including a cam surface driven by the engaging surface of the actuating-member, movement of the handle from a first position to a second position rotating the actuating member about the axle to slide the curved engaging surface along the cam surface in the direction of the distal end of the actuating member and to move the operating member relative to the tray; a first latch element mounted to the tray for movement with and being driven by the operating member; and a second latch element for releasably engaging the first latch element, movement of the operating member via the actuating member causing the first latch element to become disengaged with the second latch element.

These and other features, aspects, and advantages of the present invention will become better understood with reference to the following description and appended claims.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings.

DESCRIPTION OF THE PREFERRED EMBODIMENT

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features, and aspects of the present invention are disclosed in, or are obvious from, the following detailed description. It is to be understood by one of ordinary skill in the art that the present discussion is a description of exemplary embodiments only and is not intended as limiting the broader aspects of the present invention, which broader aspects are embodied in the exemplary constructions.

Figure 1:
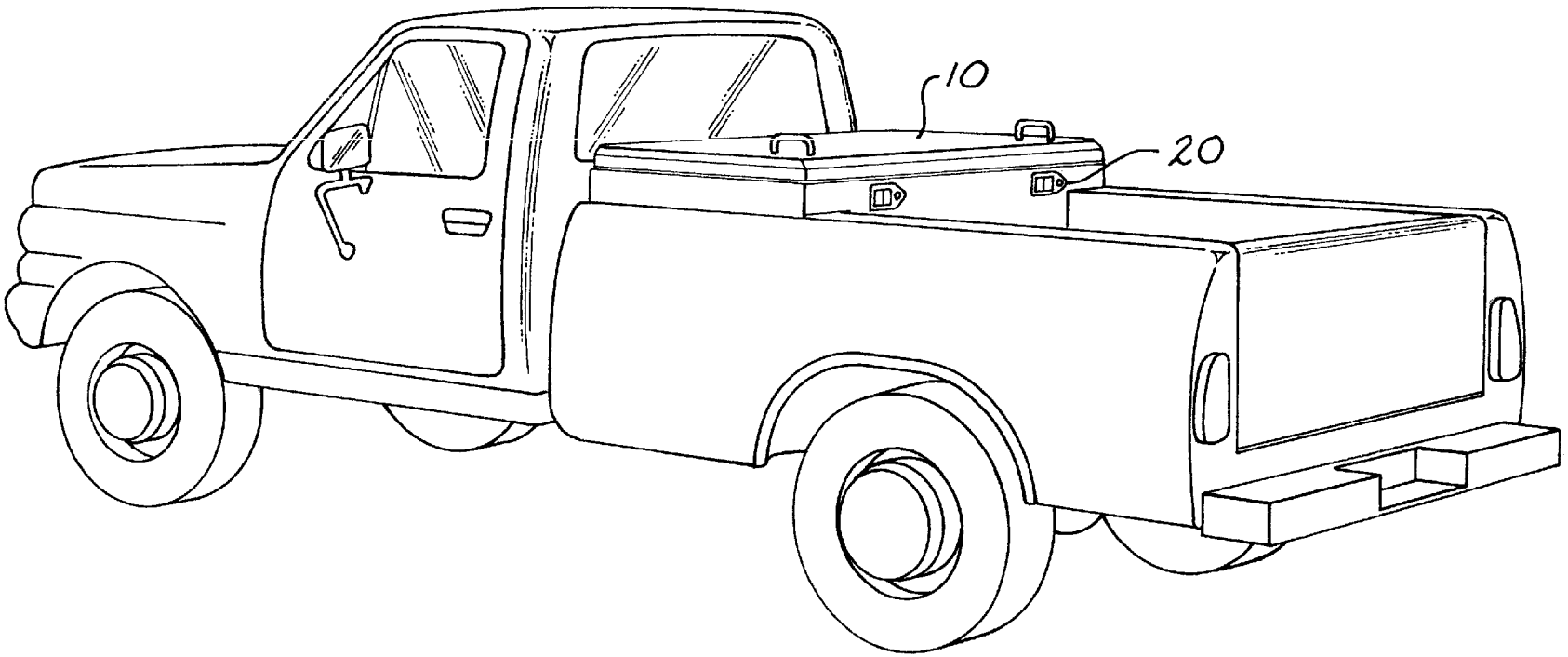
FIG. 1 is a perspective view of the present invention utilized as a latching mechanism for a truck box carried within the bed of a truck.
Figure 2:
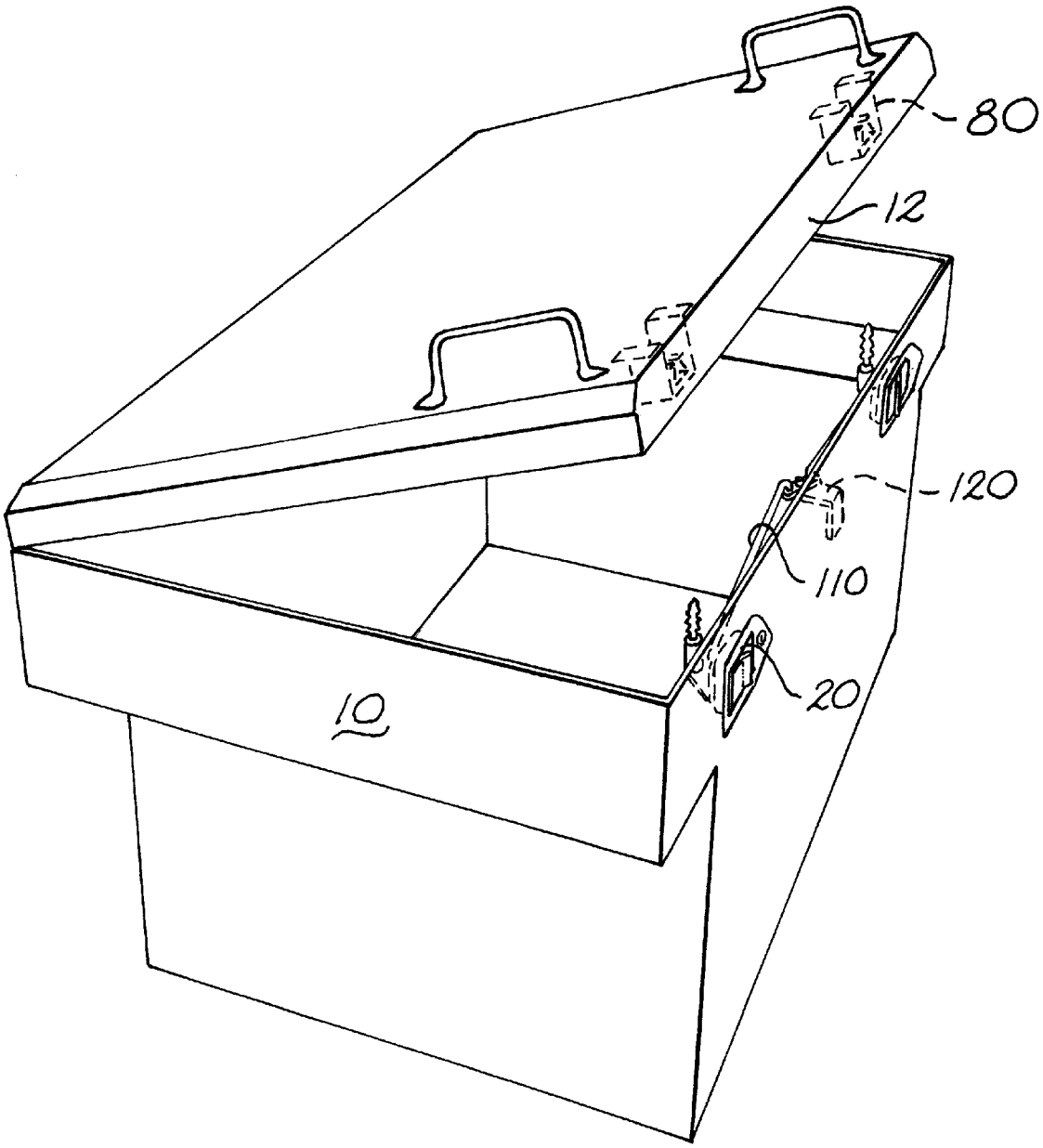
FIG. 2 is an elevated perspective view of an embodiment of the latch mechanism in relation to a truck cargo box.
Figure 3:
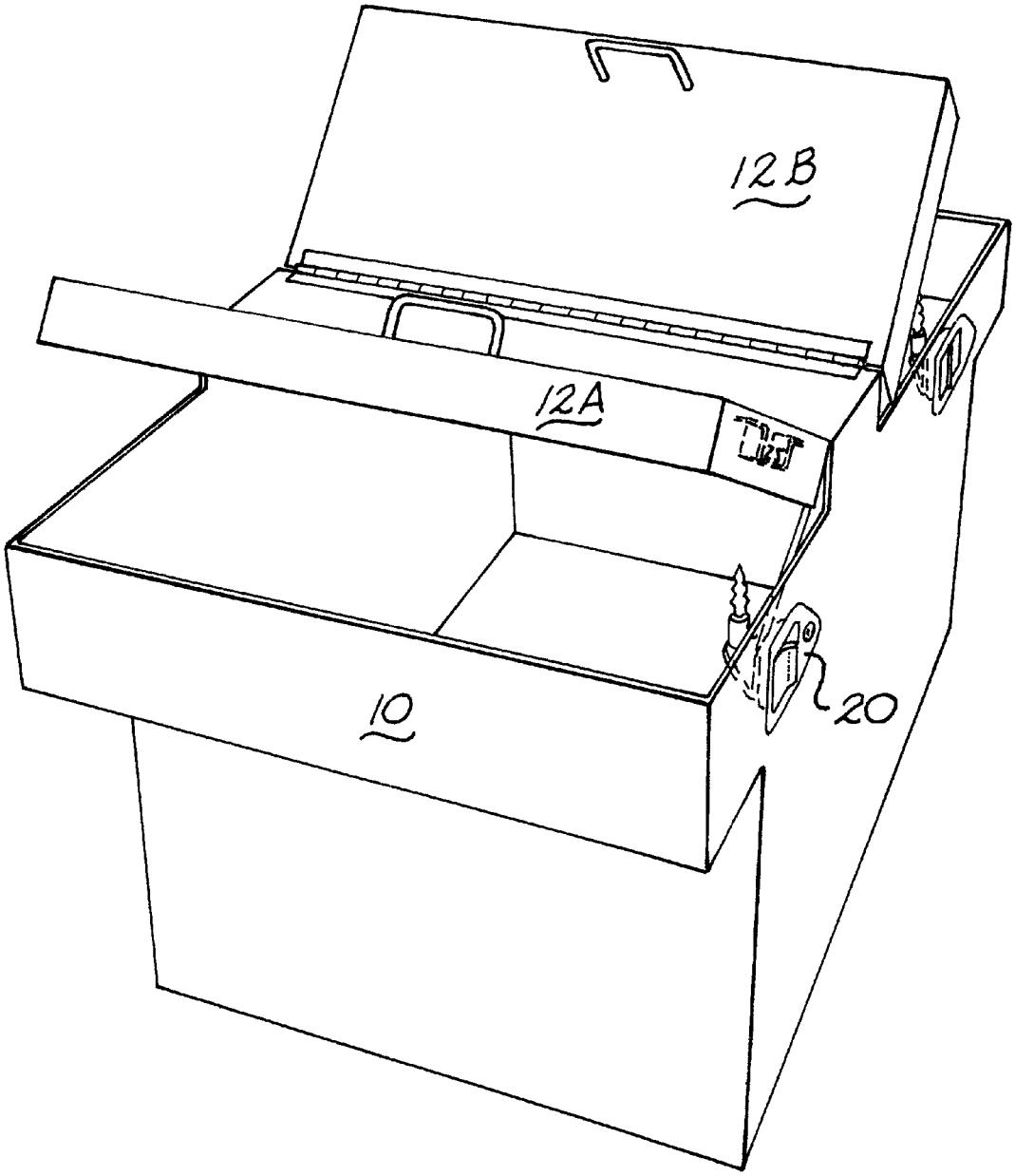
FIG. 3 is an elevated perspective view of an alternative cargo box arrangement utilizing a latching mechanism of the present invention.

The latch assembly according to the invention is illustrated in the figures generally as element 20. FIGS. 1 and 2 illustrate one embodiment of latch assembly 20 as a latch or lock element for a hinged lid cargo box. FIG. 3 further illustrates latch assembly 20 in an alternative embodiment as a tandem latching assembly for two separate hinged lids 12A and 12B. FIGS. 1–3 are only meant to illustrate a few of the possible environments of the invention. It should be understood that the latch assembly, according to the invention, can-be used in any number of environments, including panel doors of a utility truck, recreational vehicle, or any manner of commercial vehicles, lock boxes, marine applications, etc.

Referring to the figures in general, latch assembly 20 includes a housing or tray generally 22. Tray 22,has a front side 24 and a back side 26. Tray 22 may also serve as part of the means for mounting the latch assembly on a vehicle and in this regard may define a flange 28 around the circumference thereof. Flange 28 may define a plurality of mounting apertures 29 and, in one mounting configuration, would circumscribe an opening defined in the cargo box or other housing in which the latch assembly is mounted.

It should, however, be understood and appreciated that the flange 30 is not a critical feature of the invention, and merely provides one means for mounting the latch assembly. Any manner of conventional devices as may be used and known within the prior art to mount a latch assembly may be employed, such as adhesives, separate mounting brackets, and other conventional mounting devices and means.

Figures 5, 6:
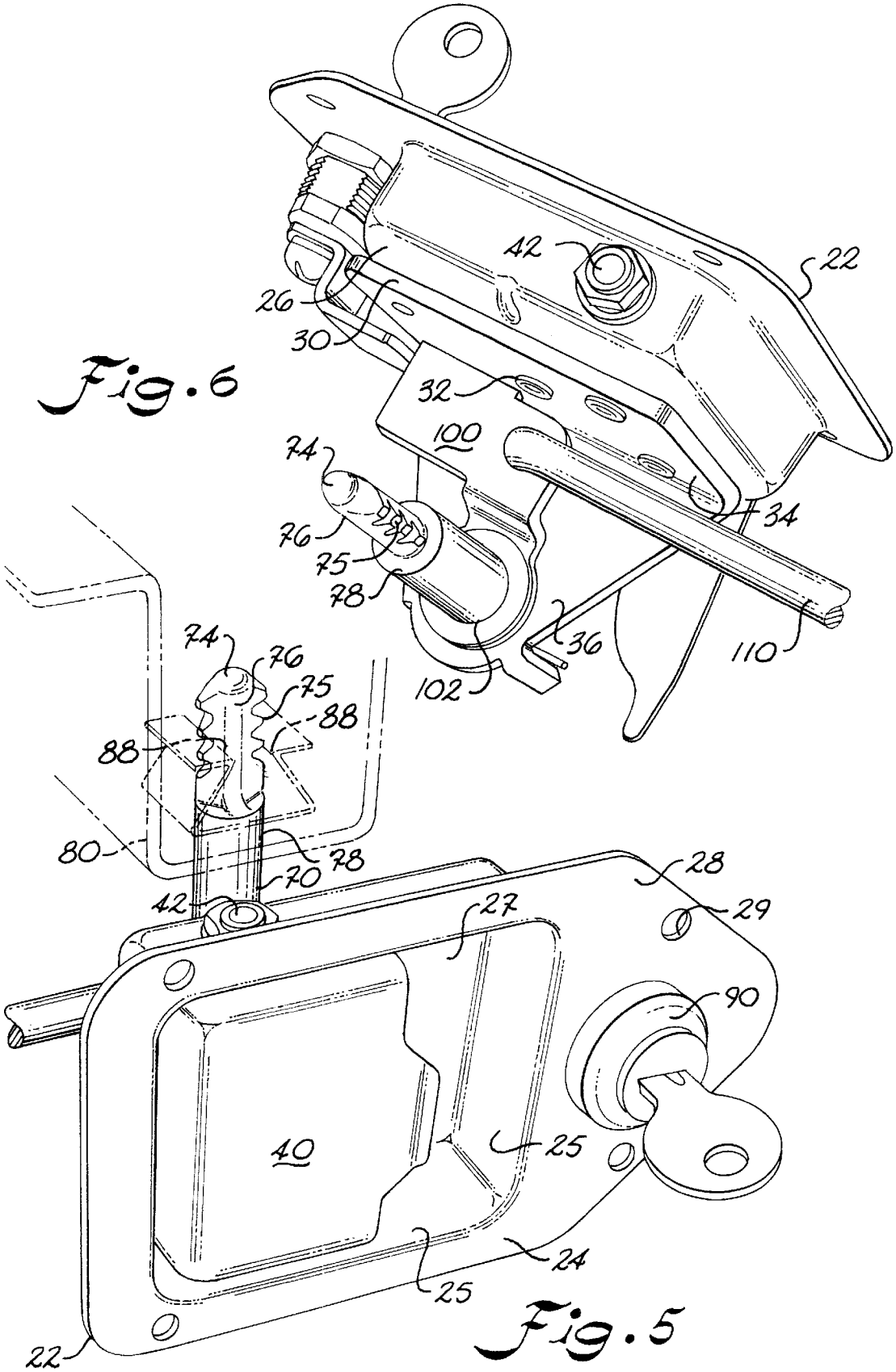
FIG. 5 is a front perspective view of the latch assembly illustrating the keeper stud secured in a locked position of the receiving mechanism.
FIG. 6 is an elevated rear perspective view of latch assembly illustrating the rotating keeper stud in relation to an optional linkage rod in communication with the operating member.

As seen in FIG. 5, handle assembly 20 also includes a handle member 40, seen here as a paddle handle. However, handle 40 may take the form of any number of desired configurations. Handle 40 is mounted on the front side 24 of tray 22 so that it can be pulled outward, as particularly seen in FIGS. 9B and 9C. In a preferred embodiment, handle 40 is pivotally mounted by way of axle 42 to tray 22. Tray 22 further defines side wall members 25 which define a cavity 27. This arrangement positions the front surface of handle member 40 substantially flush within cavity 27 as particularly seen in FIG. 5.

The back side 26 of tray 22 has a mounting bracket 30 attached. As seen in reference to FIGS. 6 and 7, mounting bracket 30 defines a flat plate 34 which is attached with rivets 32 to tray back side 26. A support arm 36 extends substantially perpendicular away from the flat plate 34 and back side 26 of tray 22. As best described below, mounting bracket 30 is used to support and position additional components of the latch assembly.

Referring particularly to FIGS. 7 and 9A–9C, an actuating member 50 is operatively connected to handle member 40 to pivot therewith. Actuating member 50 is mounted on a portion of axle 42 that extends through side wall 25 of tray 22. Thus, actuating member 50 is rotatable with handle 40 to actuate the mechanism on the back side 26 of tray 22. As seen in the figures, actuating member 50 may comprise a piece of flat metal having a leading edge 52 which may comprise an arcuate or otherwise curved edge, the actuating member being used to actuate further elements of the latch assembly.

Figure 7:
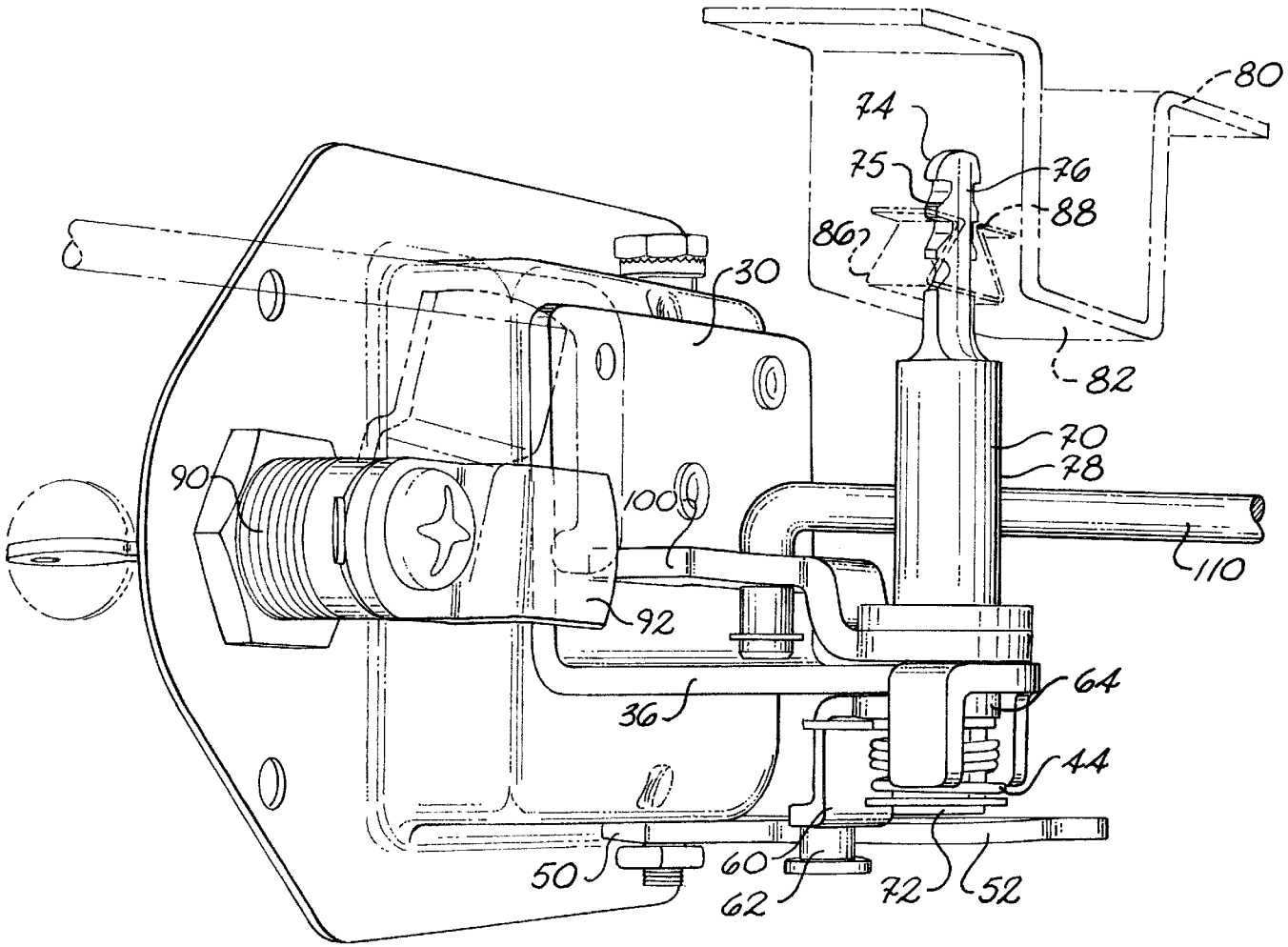
FIG. 7 is a back view of the latch assembly illustrating the latching mechanism in a locked position.
Figure 8:
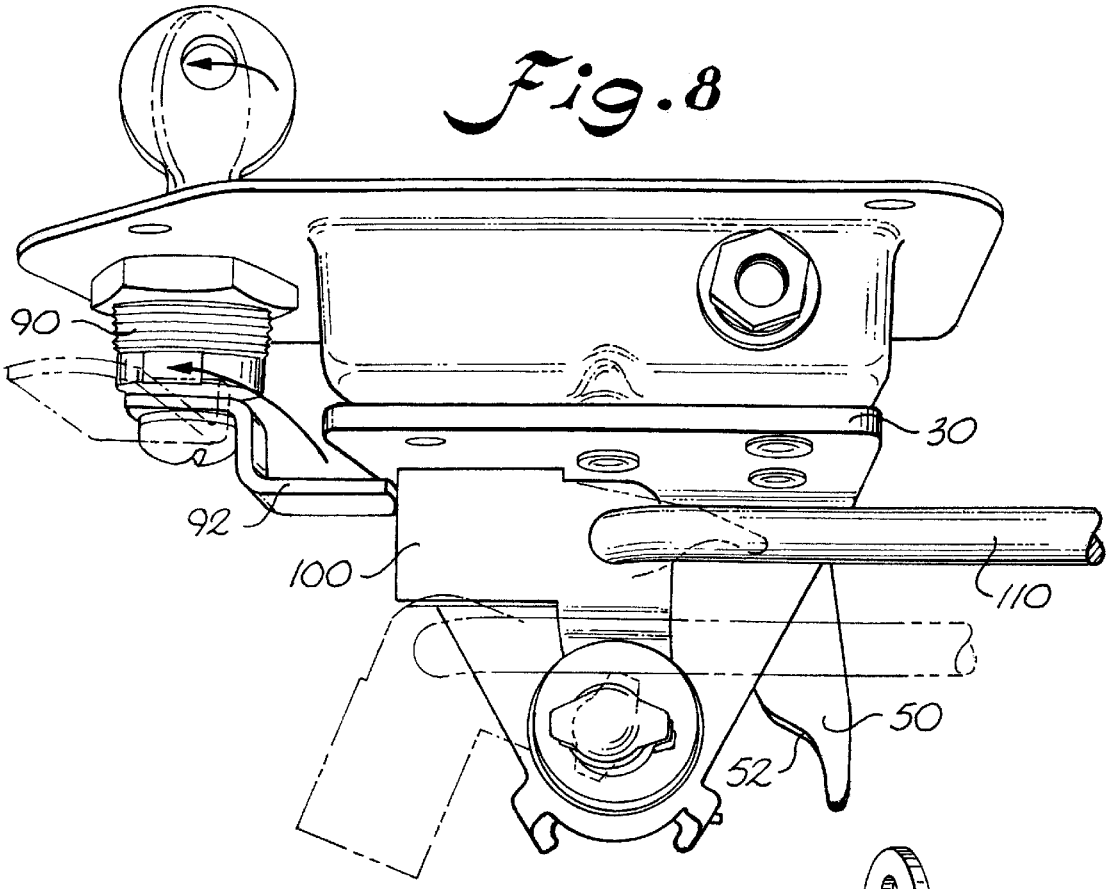
FIG. 8 is a top perspective view, similar to FIG. 6, showing the relative movement of a locking cam member and the operating member with the engaging portion of the keeper stud removed for purposes of clarity.
Figure 9A:
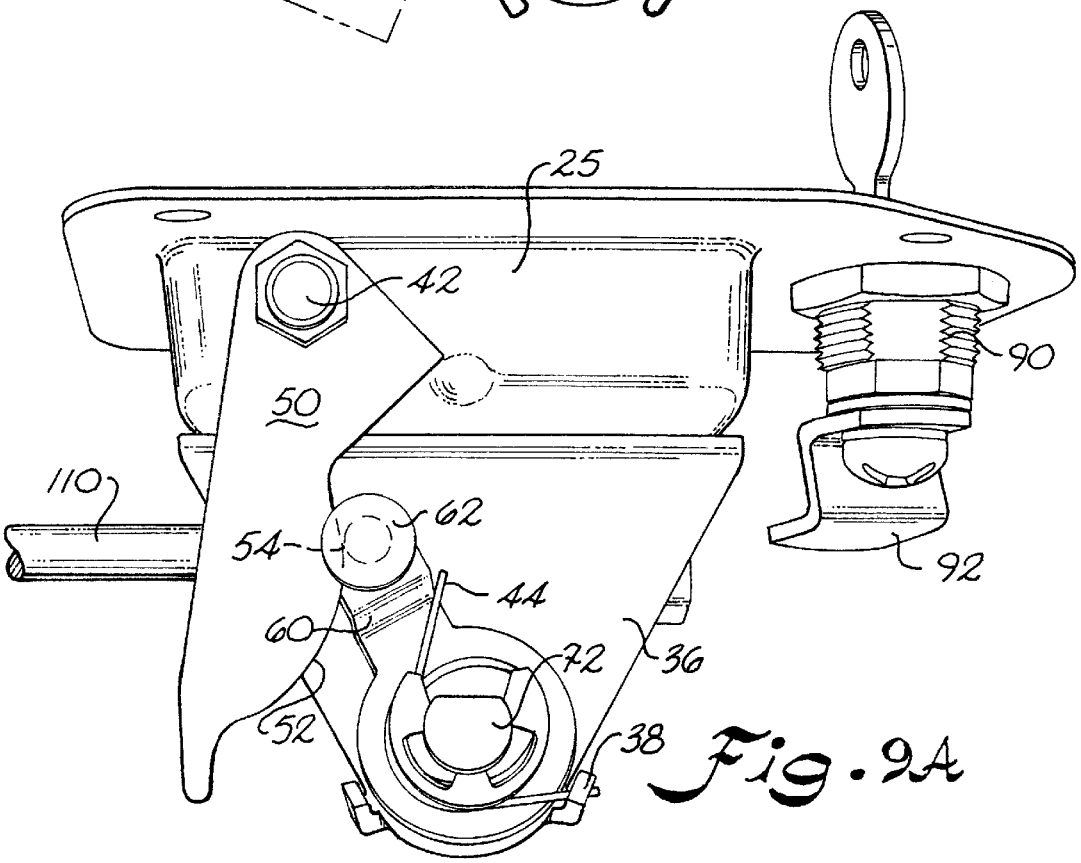
FIG. 9A is a bottom perspective view of the latch assembly as seen in FIG. 6.
Figure 9B:
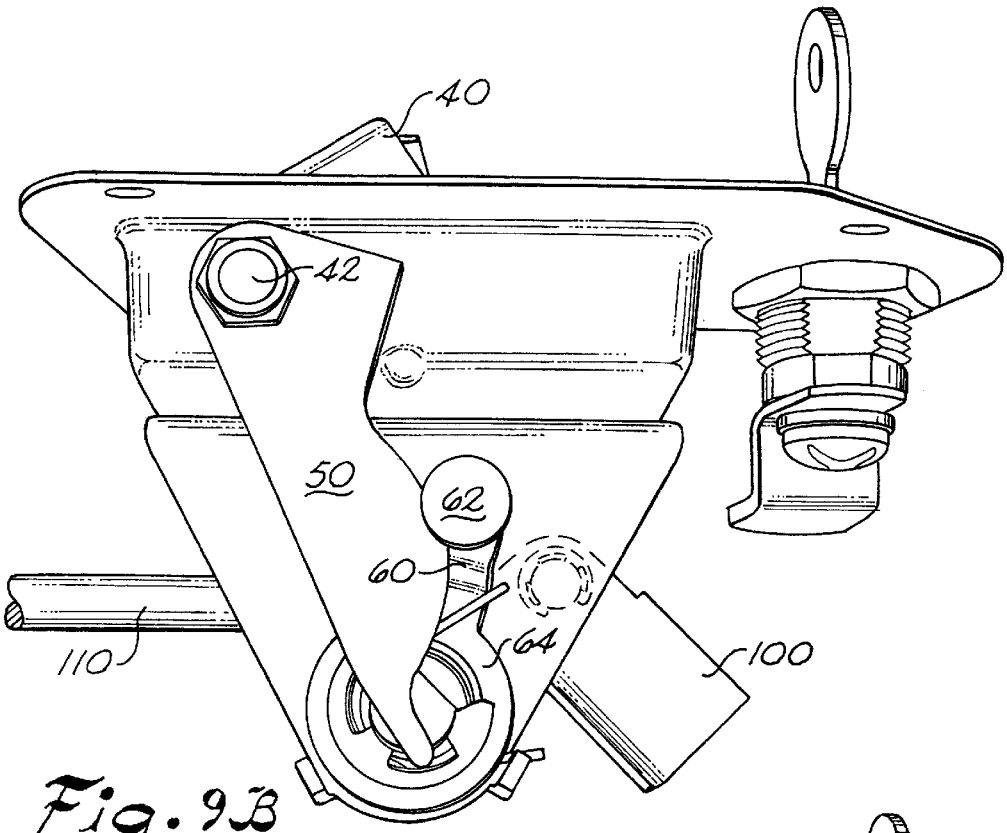
FIG. 9B is a bottom perspective view, similar to FIG. 9A, showing the handle member, actuating member, and operating member in open and unlocked configuration.
Figure 9C:
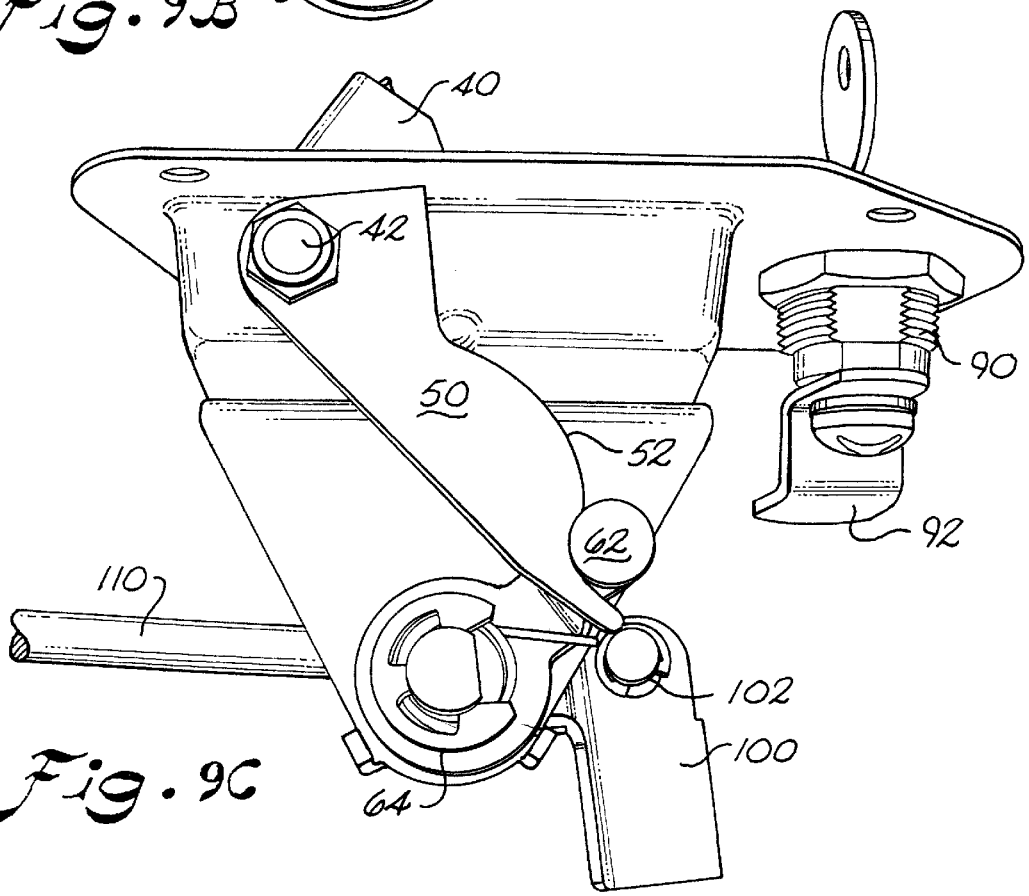
FIG. 9C is a view similar to FIG. 9B showing the handle member, actuating member, and operating member in a fully engaged and unlocked position.

Edge 52 of actuating member 50 engages an operating member 60 mounted for pivotal or rotational movement on back side 26 of tray 22. In the embodiment illustrated, operating member 60 is mounted so as to engage and rotate a base 72 of keeper stud 70. As seen in FIGS. 7, 9A, and 9C, base 72 of keeper stud 70 traverses an aperture defined by support arm 36, this arrangement maintaining keeper stud 70 substantially parallel to the plane of the flat tray back side 26. The operating member 60 defines a collar 64 through which keeper stud base 72 passes, collar 64 gripping an outer perimeter of the base 72. Operating member 60 further defines a pin 62 which is positioned opposite the arcuate edge 52 of actuating member 50. As best seen in reference to FIG. 9A, edge 52 defines a convex surface. As seen in reference to the sequential positions seen in FIGS. 9A–9C, a shoulder region 54 initially engages the cam 62 of operating member 60. As actuating member 50 is pivoted, shoulder 54 continues to engage cam 62 as the actuating member 50 pivots operating member 60. As seen in the intermediate position of FIG. 9B, shoulder 54 and cam 62 continue to make contact along a substantial travel distance of the actuating member 50 and operating member 60. As the engagement continues (FIG. 9C), the peak and far shoulder of edge 52 engage cam 62 and fully extend the operating member. Accordingly, operating member 60 is movable by the engagement of the edge 52 relative to pin 62 allowing movement between a locked position (FIG. 9A), an intermediate position (FIG. 9B) and an unlocked position (FIG. 9C). When so engaged, the displacement of operating member 60 by edge 52 rotates collar 64 which, in turn, rotates base 72 and keeper stud 70.

A coil spring 44 is used to provide a tensioned return mechanism for the latch assembly upon the release of handle 40. spring 44 is wrapped around base 72 with one end of spring 44 engaging a projection 38 (FIG. 9A) of support arm 36, a second end of spring 44 in communication with operating member 60. In the illustrated embodiments, the coil spring 44 acts upon operating member 60 to urge operating member and the interlinked components toward an initial configuration.

Figure 10:
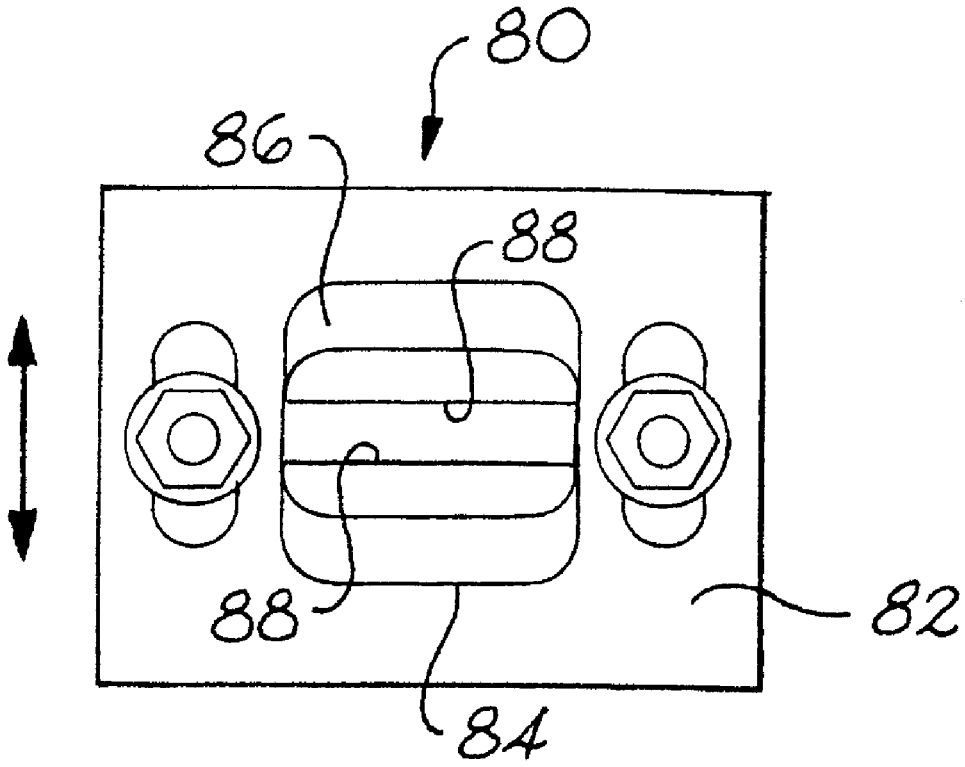
FIG. 10 is a plan view of a front face of the receiving mechanism of the latch assembly.

A distal end 74 of keeper stud 70 is defined partially by a plurality of notches 75 (defining teeth therebetween) on opposing side walls. As best seen in reference to FIGS. 5–7, distal end 74 further defines a pair of opposing smooth surfaced beveled walls 76 positioned at an approximate right angle to the opposing side walls defining notches 75. A cylindrical midsegment 78 of keeper stud 70 interconnects the distal end 74 with the base 72. The notches 75 and beveled walls 76 of keeper stud 70 will operatively engage a receiving mechanism 80 as best seen in reference to FIGS. 5, 7, and 10. Receiving mechanism 80 provides a face plate 82 such as a surface of a support bracket or other housing. Plate 82 defines an opening 84 in communication with an adjacent aligned keeper 86. Keeper 86 is slidably movable within a pair of attachment slots defined by face plate 82, the slots allowing movement of keeper 86 as indicated by directional arrow in FIG. 10.

Figure 4:
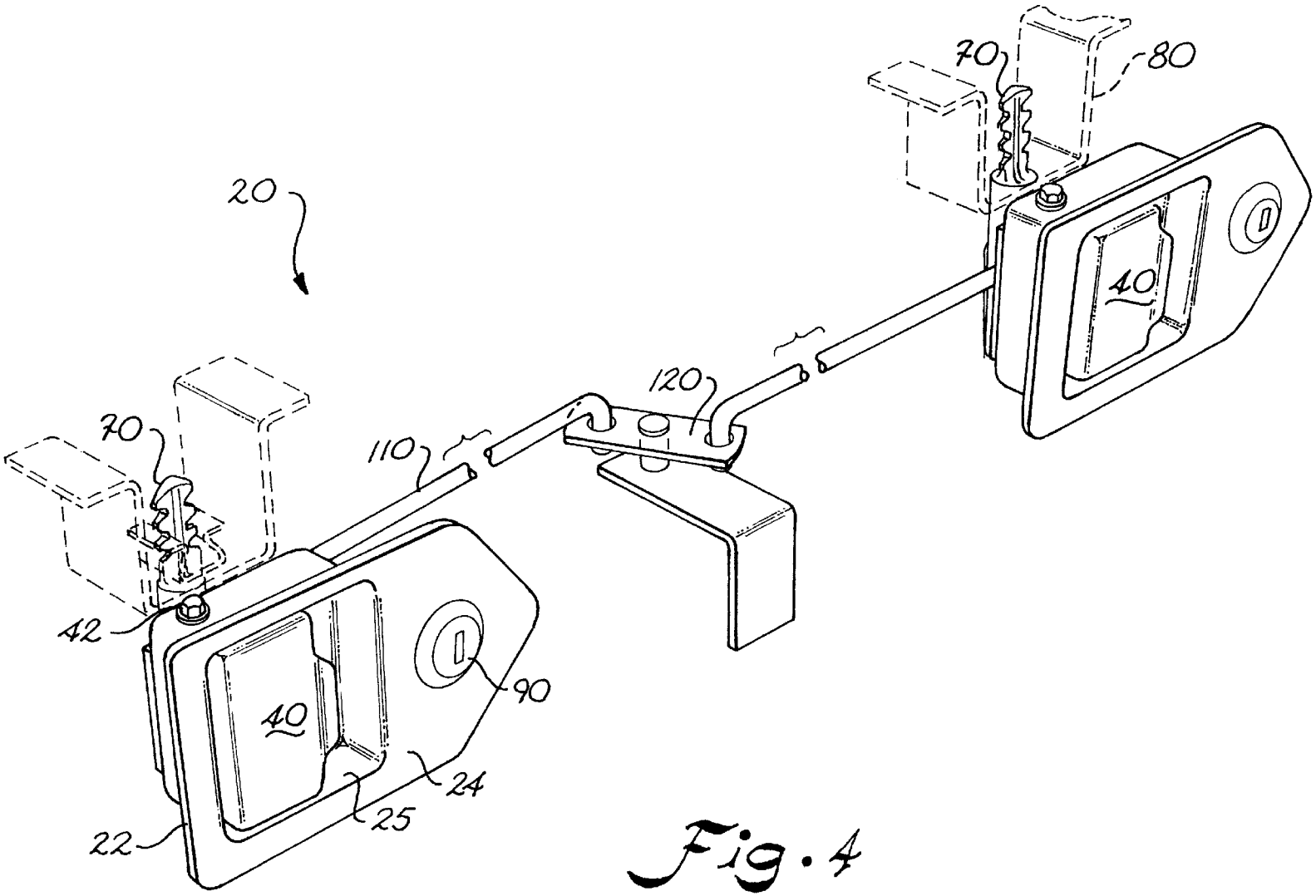
FIG. 4 is an operational front perspective view of the latch assembly useful in the cargo box seen in FIG. 3.

As seen in reference to FIG. 4, keeper stud 70 may engage receiving mechanism 80 so as the notches 75 of the distal end sidewalls engage a corresponding edge of the spaced apart tensioned lips 88 thereby providing a locked orientation. In this position, the lips clasp the notched side wall regions, the interengagement of lips 88 and notches 75 preventing the withdrawal of the keeper stud from the receiving mechanism 80.

To provide an unlocked keeper stud position, an operator would engage handle 40, pivoting the handle approximately 45 degrees. Movement of the handle in turn pivots actuating member 50 causing edge 52 to rotate operating member 60. The rotation of member 60 causes collar 64 to simultaneously rotate keeper stud 70 by the engagement of base 72. Ideally, in the illustrated embodiments, it is useful to rotate the keeper stud 70 approximately 90 degrees about its longitudinal axis, thereby positioning the smooth beveled edges 76 opposite the engaging lips 88. In this unlocked position, the relative movement between the beveled edges 76 and the opposing tensioned lips 88 is facilitated. Further, the distance between the notched walls 75 is greater than the distance between the smooth surfaced walls 76. As a result, the keeper stud may have the receiving mechanism more easily withdrawn when the smooth surface, thinner profile of walls 76 are positioned between the engaging edges of lips 88. Accordingly, a lid of a lock box carrying the receiving mechanism 80 can be opened by the withdrawal of the receiving mechanism 80 from the keeper stud.

Keeper stud base 72 may also be used to engage a receiving aperture 102 (FIG. 6) defined by a linkage rod cam 100. The linkage rod cam 100 and keeper stud base 72 are coupled together for integrated movement. In this manner, a linking rod 110 can connect via a turnbuckle 120 to a similar rod cam 100 of a second interlinked latch adjacent a first latch assembly (FIG. 4). This coupled, tandem arrangement enables simultaneous operation and control of both latch assemblies by the engagement of a single handle.

The coordinated movement of the latch assembly set forth here makes use of a keeper stud base 72 which is in coupled linkage with linkage rod cam 100 and operating member 60. As a result, keeper stud 70, linkage rod cam 100 and operating member 60 are interconnected so as to provide for integrated movement. Or, as stated another way, when any element of keeper stud 70, operating member 60, or linkage rod cam 100 is prevented from movement, none of the integrated individual parts will operate and paddle handle 40 will not pivot.

As a result, a variety of locking mechanisms may be used to limit the rotational movement of the integrated, coupled parts. One such mechanism can be provided by a key-operated lock mechanism 90 of conventional design such as a keyed cylinder which may be used to vary a position of a leg member 92 between a locked and an unlocked position. As seen in FIG. 7, leg member 92 may be used to block movement of linkage rod cam 100 thereby preventing the movement of keeper stud 70. As a result, the keeper stud 70 is maintained in a locked position relative to the receiver mechanism 80. It is apparent by those skilled in the art, that when two or more latch assemblies are interconnected by a common linking rod 110, or individual linking rods 110 connected by a turnbuckle 120 (FIG. 4), any single lock assembly which is maintained in a locked position will prevent the normal operation of both latch assemblies 20. In other words, locking any one of the latch assemblies will prevent the engagement of handle 40 and the subsequent engagement of actuating member 50, operating member 60, keeper stud 70, and linkage rod cam 100 of all interlinked latch assemblies 20. Thus, if desired, a lock assembly need only be provided on one of the two connected latch assemblies to achieve locking of both latch assemblies.

The present invention provides a novel latching mechanism which utilizes a notched keeper stud which is operatively connected to the handle and rotates in response to the engagement of the handle. The rotation allows the notched surfaces to disengage from a retaining edge disposed within a receiving element. As a result, the pivoting motion of the handle is translated into a rotational movement of the cylindrical keeper stud.

The use of a curved, convex surface to engage the operating member allows a greater movement of the operating member, without substantial increase in force required on the handle by the user, than would be achieved by a flat edge engaging surface. This arrangement allows a relatively short pivot motion of the handle to effect a proportionally increased distance of travel of the operating member. As a result, a ⅛ turn of the handle pivot results in a full ¼ turn of the stud keeper.

Further, the latch assembly provides a smooth fluid operation in which the initial pivoting motion of the handle achieves the greatest movement of the operating member, and hence, the keeper stud as well. In this manner, the initial movement of the handle where the user has the greatest leverage coincides where the greatest frictional force is need to overcome the positioning of the notched, wide edges of the keeper stud from engagement with the securing edges of the receiving mechanism. Also, the line of force at the point of contact between curved edge 52 and operating member changes as the handle is pulled, and the change serves to move the line of force to a more efficient orientation. That is, as the handle is pulled, the line of force approximates more closely a line tangent to a circle defined by the rotation of pin 62 around keeper stud 70.

It is envisioned that either the receiving mechanism or the keeper stud may be provided with a compression spring, a pneumatic lift or similar device as well known in the art to facilitate the automatic release of the receiving mechanism from the keeper stud when the keeper stud is rotated into a disengaged position.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged, both in whole or in part. Therefore, the spirit and scope of the appended claims should not be limited to the description of the preferred versions contained therein.

That which is claimed is:

1. A latch assembly for use with a receiving mechanism defining a receptacle, the latch assembly comprising:

a tray having a front side and a back side;

a handle member pivotally mounted to the tray;

an actuating member mounted to the tray and responsive to the handle member to pivot therewith relative to the tray;

an operating member rotatably mounted onto a mounting element extending from the back side of the tray, the operating member further defining a cam surface contacted by the actuating member upon movement of the handle member; and wherein when the actuating member rotates the cam surface of the operating member to an unlocked position, the keeper stud rotates from the locked orientation to the unlocked orientation.

2. The latch assembly according to claim 1 wherein pivoting of the handle member about 45 degrees about its axis of rotation pivots the keeper stud about 90 degrees about its axis of rotation.

3. The latch assembly according to claim 1 wherein the longitudinal axis of the keeper stud occupies a plane substantially parallel to a plane defined by a rear wall of the tray.

4. The latch assembly according to claim 1 wherein the mounting element includes a bracket having a first wall which is substantially perpendicular to the tray rear wall.

5. The latch assembly according to claim 4 wherein the bracket further defines a second wall mounted to a back of the tray.

6. The latch assembly according to claim 5 wherein the first wall and the second wall further define a right angle.

7. The latch assembly according to claim 1 wherein the actuating member defines a curved engaging surface which contacts the cam surface of the operating member.

8. The latch assembly according to claim 7 wherein the curved engaging surface is convex.

9. The latch assembly according to claim 7 wherein when the handle is pivoted, a shoulder region of the arcuate engaging surface of the actuating member engages the cam surface.

10. The latch assembly according to claim 1 wherein the receiving mechanism is mounted to a lid of a container and the keeper stud is positioned from a body of the container.

11. The latch assembly according to claim 1 wherein the first terminus of the keeper stud defines at least four side walls, at least one of the side walls defining the plurality of notches.

12. The latch assembly according to claim 11 wherein the first terminus of the keeper stud further defines a pair of smooth side walls, one member of each pair positioned at about a 90 degree angle to the at least one side wall defining the plurality of notches.

13. The latch assembly according to claim 1 wherein the keeper stud first terminus defines a pair of notched side walls on opposite edges of the keeper stud first terminus.

14. The latch assembly according to claim 13 wherein the first terminus of the keeper stud further defines an opposing pair of smooth surfaced walls.

15. The latch assembly according to claim 14 wherein the smooth surfaced walls each define a beveled surface.

16. The latch assembly according to claim 14 wherein the first terminus of the keeper stud defines a width between the notched side walls which is greater than a distance between the pair of smooth surfaced walls.

17. The latch assembly according to claim 16 wherein the pair of smooth surfaced walls are spaced at approximate right angles to the pair of notched side walls.

18. The latch assembly according to claim 1 wherein the receiving mechanism further comprises a pair of spaced edges opposite an opening defined by a platform.

19. A latch assembly comprising:

a receiving mechanism adapted for attachment to a lower surface of a lid of a receptacle;

a handle member pivotally mounted to a housing, the housing secured to a wall of the receptacle, the handle member being accessible from an exterior of the receptacle;

a keeper stud operatively engaged by the handle member and defining a first end having at least one notched edge which engages an edge member within the receiving mechanism when the keeper stud is in a first locked orientation, the keeper stud rotating in to a unlocked position upon engagement of the handle member, the unlocked position disengaging the at least one notched edge from the edge member of the receiving mechanism and thereby permitting removal of the lid and receiving mechanism from the keeper study.

20. The latch assembly according to claim 19 wherein the first end of the keeper stud defines at least four side walls, at least one of the side walls defining a plurality of notches.

21. The latch assembly according to claim 19 wherein the first end of the keeper stud further defines a pair of smooth side walls, each member of the pair positioned at about a 90 degree angle to the at least one side wall defining a plurality of notches.

22. The latch assembly according to claim 19 wherein the keeper stud first end defines a pair of notched side walls on opposite edges of the keeper stud first end.

23. The latch assembly according to claim 22 wherein the first end of the keeper stud further defines an opposing pair of smooth surfaced walls.

24. The latch assembly according to claim 23 wherein the smooth surfaced walls each define a beveled surface.

25. The latch assembly according to claim 22 wherein the first end of the keeper stud defines a width between opposing notched side walls which is greater than a distance between a pair of opposite smooth surfaced side walls.

26. The latch assembly according to claim 25 wherein the pair of smooth surfaced side walls are spaced at approximate right angles to the pair of notched side walls.

27. The latch assembly according to claim 19 wherein the latch assembly further comprises a bracket traversed by a base of the keeper stud.

28. The latch assembly according to claim 27 wherein the keeper stud defines an axis having a plane parallel to a plane defined by the receptacle wall.

29. The latch assembly according to claim 1 wherein the latch assembly further comprises a cam member carried by the base of the keeper stud, the cam member engaging a pivotal leg member of a locking mechanism.

30. The latch assembly according to claim 29 wherein the cam member of a first latch assembly is in communication with a first end of a linkage rod, the linkage rod having a second end in communication with a turnbuckle, the turnbuckle being in like communication with a second latch assembly through a second linkage rod.

31. A latch assembly comprising:

a tray having a front side and a back side;

a handle member pivotally mounted to the tray via an axle;

an actuating member mounted to the axle and responsive to the handle member to pivot therewith relative to the tray, the actuating member defining an engaging surface disposed between a base end of the actuating member adjacent the axle and a distal end of the actuating member, the engaging surface being curved and configured so that the engaging surface extends more radially relative to the axle nearer the base end and less radially relative to the axle nearer the distal end;

an operating member mounted to the tray so as to be movable relative thereto and including a cam surface driven by the engaging surface of the actuating member, movement of the handle from a first position to a second position rotating the actuating member about the axle to slide the curved engaging surface along the cam surface in the direction of the distal end of the actuating member and to move the operating member relative to the tray;

a first latch element mounted to the tray for movement with and being driven by the operating member; and a second latch element for releasably engaging the first latch element, movement of the operating member via the actuating member causing the first latch element to become disengaged-with the second latch element.

32. The latch assembly according to claim 31 wherein pivoting of the handle member about 45 degrees about its axis of rotation pivots the first latch mechanism about 90 degrees about its axis of rotation.

33. The latch assembly according to claim 31 wherein a longitudinal axis of the first latch mechanism occupies a plane substantially parallel to a plane defined by a rear wall of the tray.

34. The latch assembly according to claim 31 wherein the second latch element is mounted to a lid of a container and the first latch element is positioned from a body of the container.

35. The latch assembly according to claim 31 wherein a terminus of the first latch element defines at least four side walls, at least one of the side walls defining a notched edge wall.

36. The latch assembly according to claim 35 wherein the terminus of the first latch element further defines a pair of smooth side walls, one member of each pair positioned at about a 90 degree angle to the at least one side wall defining a notched edge wall.

37. The latch assembly according to claim 31 wherein the terminus of the first latch element defines a pair of opposing notched side walls.

38. The latch assembly according to claim 37 wherein the terminus of the first latch element further defines an opposing pair of smooth surfaced walls.

39. The latch assembly according to claim 38 wherein the smooth surfaced walls each define a beveled surface.

40. The latch assembly according to claim 39 wherein the terminus of the first latch element defines a width between the notched side walls which is greater than a distance between the pair of smooth surfaced walls.

41. The latch assembly according to claim 40 wherein the pair of smooth surfaced walls are spaced at approximate right angles to the pair of notched side walls.

42. The latch assembly according to claim 31 wherein the second latch element further comprises a pair of spaced edges opposite an opening defined by a platform.

* * * * *

UNITED STATES PATENT AND TRADEMARK OFFICE

CERTIFICATE OF CORRECTION

PATENT NO. : 6,349,577 B1
DATED : February 26, 2002
INVENTOR(S) : Hansen et al.

It is certified that error appears in the above-identified patent and that said Letters Patent is hereby corrected as shown below:

Column 7,
After line 37, add
-- a keeper stud having a first terminus defining a plurality of notches and a second terminus defining a base, the base rotatably mounted onto the mounting element, the operating member non-rotatably mounting to the keeper stud base; the keeper stud rotatable between a locked orientation in which the notches engage the receptacle and an unlocked orientation in which the notches disengage the receptacle; --.

Column 8,
Line 44, change "study" to -- stud --.

Signed and Sealed this

Eighth Day of April, 2003

JAMES E. ROGAN
*Director of the United States Patent and Trademark Office*